US006621218B1

(12) United States Patent
Matsumoto

(10) Patent No.: US 6,621,218 B1
(45) Date of Patent: Sep. 16, 2003

(54) LINE LIGHT SOURCE AND IMAGE SENSOR USING THE SAME

(75) Inventor: Toshio Matsumoto, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 308 days.

(21) Appl. No.: 09/644,838

(22) Filed: Aug. 24, 2000

(30) Foreign Application Priority Data

Mar. 17, 2000 (JP) ..... 2000-075500

(51) Int. Cl.[7] ..... H01J 65/00; H01J 11/00

(52) U.S. Cl. ..... 313/607; 313/484; 313/631; 313/635; 358/482; 358/496; 358/498; 250/208.1

(58) Field of Search ..... 313/484, 607, 313/631, 635; 358/482, 483, 484, 471–473, 496–498; 250/208.1

(56) References Cited

U.S. PATENT DOCUMENTS 4,839,730 A * 6/1989 Shirakoshi et al. ..... 348/294
5,038,027 A 8/1991 Ioka ..... 250/208.1
5,182,445 A 1/1993 Yamashita ..... 250/208.1
5,254,847 A * 10/1993 Hata et al. ..... 250/208.1
5,489,992 A 2/1996 Endo ..... 358/482
5,581,076 A * 12/1996 Tabata ..... 250/208.1
5,713,608 A * 2/1998 Yang ..... 285/149.1
6,014,231 A * 1/2000 Sawase et al. ..... 250/208.1

FOREIGN PATENT DOCUMENTS

JP 7-288654 10/1995
JP 9-120704 5/1997
JP 11317201 A * 11/1999 ..... H01J/65/00

* cited by examiner

*Primary Examiner*—Nimeshkumar D. Patel
*Assistant Examiner*—Sikha Roy
(74) *Attorney, Agent, or Firm*—Oblon, Spivak, McClelland, Maier & Neustadt, P.C.

(57) ABSTRACT

A line light source according to the present invention is provided with a plurality of external electrode rare gas fluorescent lamps, and a fixing member fixing the plurality of external electrode rare gas fluorescent lamps such that the center lines thereof are aligned. A contact image sensor of the present invention is provided with the above mentioned line light source.

14 Claims, 16 Drawing Sheets

LINE LIGHT SOURCE AND IMAGE SENSOR USING THE SAME

BACKGROUND OF THE INVENTION

1. Field of the Invention

The present invention relates to line light sources and image sensors using the same and, more particularly to a line light source of an image sensor which can be used for an image inputting portion of a large image input/output apparatus of a size exceeding A3 (JIS (see Japanese Industrial Standard) B0191) and an image sensor provided with the same.

2. Description of the Background Art

FIG. 16 is a cross sectional view showing a conventional image sensor 13, and FIG. 17 is a partial view showing a hot cathode fluorescent lamp, which is a line light source 51 of image sensor 13.

Referring to FIG. 16, image sensor 13 includes: a casing (a sensor frame) 19 holding components therein; the hot cathode fluorescent lamp used as line light source 51; a rod lens array 15 for erect and equimagnification imaging including a plurality of rod lens; a sensor substrate 16; a sensor IC 17 linearly placed on sensor substrate 16; and a glass plate 18 serving as a surface over which a manuscript 14 is transported. A heater 41 is arranged at the periphery of line light source 51.

Referring to FIG. 17, line light source 51 is provided with a glass tube 42, a lead wire 45, and an electrode 44. A fluorescent material is applied to the inner wall of glass tube 42, and glass tube 42 internally includes mercury and an inactive gas (argon, neon and the like). A filament 43 forming a part of electrode 44 is provided, to which an emissive material called an emitter is applied.

Now, the operation will be described. The light from the hot cathode fluorescent lamp passes through glass plate 18, so that manuscript 14 is uniformly illuminated with light. The illumination light is reflected by manuscript 14 in accordance with the shading information of an image to be directed into the rod lens of rod lens array 15 and to sensor IC 17.

Sensor IC 17 accumulates electric charges in accordance with the intensity of the reflected light, and data is output through sensor substrate 16. The vapor pressure of the mercury in the hot cathode fluorescent lamp varies according to the temperature, and the luminance of the hot cathode fluorescent lamp changes by the variation in the vapor pressure of the mercury. Thus, heater 41 is used to keep the temperature of the hot cathode fluorescent lamp constant. The luminance of the hot cathode fluorescent lamp is kept constant by heater 41.

The hot cathode fluorescent lamp emits light by the following operation.

① A current is applied to electrode 44 through lead wire 45 to preliminary heat filament 43.

② Thermoelectrons are discharged from the emitter (emissive material) applied to filament 43.

③ The thermoelectrons move toward electrode 44 on the opposite side as attracted.

④ The thermoelectrons collide with mercury atoms as attracted to electrode 44 to produce ultraviolet rays.

⑤ The ultraviolet rays are directed to the fluorescent material applied to the inner wall of glass tube 42 to produce visible rays.

A light emitting diode, an external electrode rare gas fluorescent lamp or the like is used as a light source of the image inputting portion, instead of the hot cathode fluorescent lamp. However, for a large image inputting portion having a size exceeding A3, the hot cathode fluorescent lamp producing a sufficient amount of light and allowing an illumination length exceeding A3 is used.

The above described structure of the hot cathode fluorescent lamp of the conventional line light source requires heater 41 to keep the ambient temperature of the hot cathode fluorescent lamp and the vapor pressure of mercury therein constant so that the luminance of the hot cathode fluorescent lamp is kept constant, and further requires a control circuit for heater 41. In addition, the use of mercury adversely affects the environment when the hot cathode fluorescent lamp is discarded, and therefore, the mercury should not be used.

An external electrode rare gas fluorescent lamp causing less variation in luminance according to a temperature may be used in place of the hot cathode fluorescent lamp suffering from the aforementioned problems. The external electrode rare gas fluorescent lamp will be described with reference to FIGS. 18 to 21.

FIG. 18 is a side view showing an external electrode rare gas fluorescent lamp. As shown in FIG. 18, a line light source (external electrode rare gas fluorescent lamp) 1 includes a glass tube 2, outer electrodes 4, 5, a lamp holder 8 provided at both ends, and two lead wires 10.

A fluorescent material is applied to the inner wall of glass tube 2, and glass tube 2 internally includes an inactive gas (xenon or the like). Outer electrodes 4, 5 are arranged opposite to each other with glass tube 2 therebetween, each connected to one lead wire 10. Lamp holder 8 is used for holding the external electrode rare gas fluorescent lamp to a contact image sensor.

FIG. 19 is a cross sectional view taken along the line 300—300 of the external electrode rare gas fluorescent lamp shown in FIG. 18. FIG. 20 is a cross sectional view taken along the line 400—400 of the external electrode rare gas fluorescent lamp shown in FIG. 19. FIG. 21 is a graph showing a distribution of illumination light from line light source 1 shown in FIG. 18, where an abscissa represents the position of line light source 1 and an ordinate represents brightness.

The above described external electrode rare gas fluorescent lamp emits light by the following operation.

① A high frequency high voltage is applied to outer electrodes 4, 5 through lead wire 10.

② Xenon atoms are discharged to produce ultraviolet light.

③ The ultraviolet light is directed to a fluorescent material applied to the inner wall of glass tube 2 to produce visible rays.

However, the length of the external electrode rare gas fluorescent lamp is limited. This is because the external electrode rare gas fluorescent lamp is mainly used for a copier for which the size of A3 is sufficient and there is little demand for lamps having the size exceeding A3. In addition, a large amount of investment must be put to manufacture large external electrode rare gas fluorescent lamps having the large size exceeding A3. Consequently, external electrode rare gas fluorescent lamps which are large enough to be used for large image inputting portions having a size exceeding A3 are not presently supplied.

SUMMARY OF THE INVENTION

The present invention is made to solve the above mentioned problems. An object of the present invention is to provide a line light source which has a luminance stable with respect to an ambient temperature and which can used for a large image inputting portion having a size exceeding A3 by using a rare gas fluorescent while not using mercury, which may adversely affect the environment.

A line light source according to the present invention is provided with the first and second rare gas fluorescent lamps, and a fixing member. The first rare gas fluorescent lamp includes a first hollow body having an inner wall to which the fluorescent material is applied and including an inactive gas in an internal space thereof, and first and second electrodes positioned on the opposite sides of the internal space of the first hollow body. The second rare gas fluorescent lamp includes a second hollow body having an inner wall to which a fluorescent material is applied and including an inactive gas in an internal space thereof, and third and fourth electrodes positioned on the opposite sides of the internal space of the second hollow body. The fixing member fixes the first and second rare gas fluorescent lamps as arranged in the longitudinal direction thereof.

If the first and second rare gas fluorescent lamps are fixed by the fixing member as arranged in the longitudinal direction as described above, the line light source has a total length of the first and second rare gas fluorescent lamps. Thus, even when the rare gas fluorescent lamp is used, the length of the line light source can readily be increased.

Preferably, the fixing member fixes the first and second rare gas fluorescent lamps such that their center lines in the longitudinal direction are substantially aligned.

Thus, the length of the line light source can be increased while uniformly maintaining the luminance of the line light source.

Preferably, the fixing member has a recess receiving one ends of the first and second rare gas fluorescent lamps, and an opening exposing light emitting portions of the first and second rare gas fluorescent lamps.

Having the above described structure, the fixing member can stably fix the first and second rare gas fluorescent lamps such that their center lines are substantially aligned, whereby the length of the line light source can be increased. In addition, the light from a connecting portion of the first and second rare gas fluorescent lamps can be directed to a manuscript of the like through the opening.

The line light source is included in a casing, and the fixing member fixes the line light source in the casing.

As the line light source is fixed to the casing by the fixing member as described above, the line light source can be stably fixed. Especially, when holders at both ends of the line light source and fixing member are used, the line light source can be stably fixed to the casing.

Preferably, the fixing member connects the first and second rare gas fluorescent lamps with a space provided between the first and second hollow bodies.

Thus, even when the first and second hollow bodies are expanded due to the increased in temperature of the first and second rare gas fluorescent lamps, the ends of the first and second hollow bodies would not contact, so that the breakage of the first and second hollow bodies can be prevented. Namely, the breakage of the line light source due to the increase in temperature is prevented.

More preferably, the fixing member is provided with a reflection surface for reflecting light from at least one of the first and second rare gas fluorescent lamps.

Thus, the light from the first and second rare gas fluorescent lamps can be reflected by the reflection surface, so that the luminance at the connecting portion of the first and second rare gas fluorescent lamps can be increased. As a result, a uniform brightness can be obtained over the reading surface of the manuscript.

Preferably, the fixing member includes a protrusion protruding in a direction in which the light from the first or second rare gas fluorescent lamp is directed, and the reflection surface is provided at the protrusion.

Such provision of the reflection surface at the protrusion enables the light from the first or second rare gas fluorescent lamp to be reflected in a forward direction, and also prevents expansion of the directed light. Thus, the luminance at the connecting portion of the first and second rare gas fluorescent lamps can be more effectively increased.

The reflection surface may be provided by making the surface of the protrusion have a color tone with high reflectivity with respect to the light from the first or second rare gas fluorescent lamp.

Thus, the light from the first and second rare gas fluorescent lamps can be reflected by the reflection surface, so that the reflected light is collected and directed to the manuscript or the like.

The reflection surface may be provided by making the surface of the fixing member opposed to the first or second rare gas fluorescent lamp have a color tone with high reflectivity with respect to the light from the first or second rare gas fluorescent lamp.

In this case, the light from the first and second rare gas fluorescent lamps can be reflected by the reflection surface, so that the reflected light can be directed to the manuscript or the like.

An image sensor according to the present invention is provided with the above described line light source. Thus, a content of the manuscript having a size exceeding A3 can be read.

The image sensor preferably includes a casing in which the line light source may be included, and a moving means for moving the line light source. The moving means may move a part or all of the line light source.

Such a moving means allows the position of the line light source to be adjusted, so that the brightness at the reading surface of the manuscript can be adjusted. As a result, a uniform brightness is obtained over the reading surface of the manuscript.

The moving means may move the line light source at least in one of directions (for example in a direction indicated by an arrow in FIG. 6) toward or away from the reading surface of the manuscript.

Thus, when a sufficient brightness is not obtained over the reading surface of the manuscript, the line light source can be moved in the direction toward the reading surface of the manuscript to increase the brightness over the reading surface of the manuscript. When the brightness over the reading surface of the manuscript is too high, the line light source is moved in a direction away from the reading surface of the manuscript to reduce the brightness over the reading surface of the manuscript. In this case, only one end of the line light source may be moved to adjust the brightness over the reading surface of the manuscript.

The moving means may move the line light source to change the illumination intensity over the reading surface of the manuscript.

When the line light source is manufactured by using the rare gas fluorescent lamp, an illumination intensity distribution is caused in a direction along the surface of the line light source. In this case, the line light source is moved (for example in a direction indicated by an arrow in FIG. 7) with respect to the reading surface of the manuscript, for example, so that the line light source is arranged in a direction of different illumination intensity toward the reading surface of the manuscript. Thus, the brightness over the reading surface can be adjusted to provide a uniform brightness.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1:
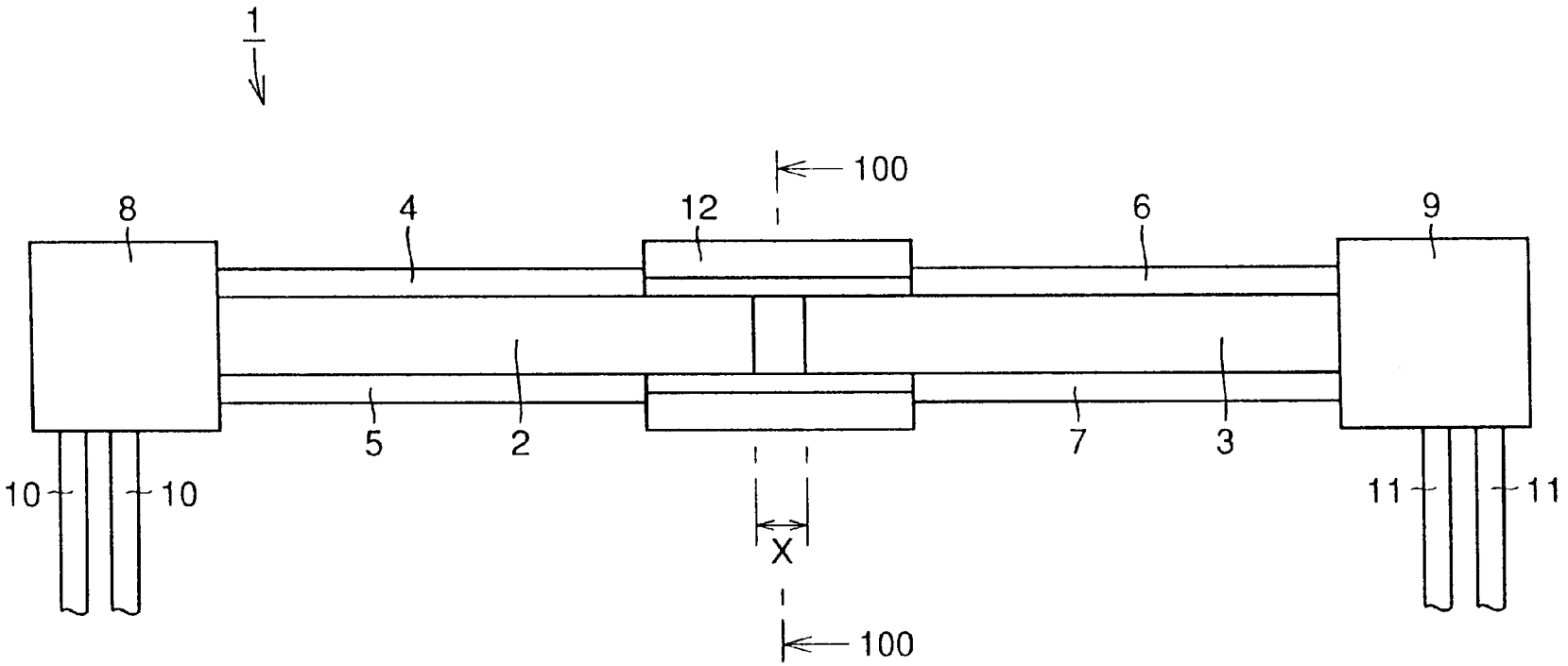
FIG. 1 is a top view of a line light source according to the first embodiment of the present invention.
Figure 2:
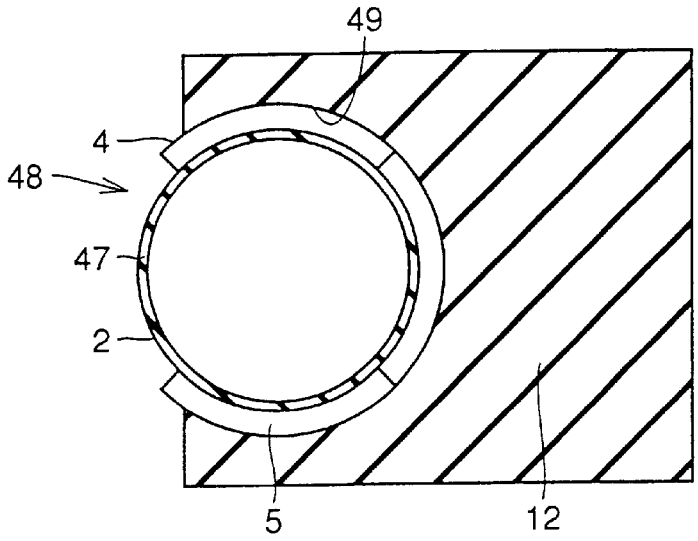
FIG. 2 is a cross sectional view of the line light source shown in FIG. 1.

Now, the first embodiment of the present invention will be described. FIG. 1 is a top view showing a line light source 1 using an external electrode rare gas fluorescent lamp. FIG. 2 is a cross sectional view taken along the line 100—100 in line light source 1 shown in FIG. 1.

Referring to FIG. 1, line light source 1 of the present invention is manufactured by combining a plurality of light sources (rare gas fluorescent lamps). More specifically, line light source 1 is manufactured by connecting ends in a longitudinal direction of the plurality of external electrode rare gas fluorescent lamps.

Thus, line light source 1 which can be used for a large image inputting portion having a size exceeding A3 by using an external electrode rare gas fluorescent lamp with a limited length.

Referring to FIG. 1, line light source 1 is manufactured by combining two rare gas fluorescent lamps, and includes glass tubes (hollow bodies) 2, 3, outer electrodes 4 to 7, lamp holders 8, 9, two lead wires 10, 11, and a fixing member 12.

A fluorescent material is applied to inner walls of glass tubes 2, 3, and glass tubes 2, 3 internally include inactive gas (xenon or the like, not using mercury).

Two outer electrodes 4, 5 are provided opposite to each other with glass tube 2 therebetween, each connected to one lead wire 10. In addition, two outer electrodes 6, 7 are provided opposite to each other with glass tube 3 therebetween, each connected to one lead wire 11.

Lamp holders 8, 9 hold two lead wires 10, 11, and lead wires 10, 11 are provided on respective sides of glass tubes 2, 3.

Fixing member 12 is arranged in the middle of glass tubes 2, 3 and connects glass tubes 2, 3 such that the center lines of glass tubes 2, 3 are substantially aligned. Fixing member 12 includes a material having for example an insulation property, is generally in a U-shape, and has a recess 49 as shown in FIG. 2.

Recess 49 of fixing member 12 receives one ends of glass tubes 2, 3. Thus, glass tubes 2, 3 are connected such that the center lines of glass tubes 2, 3 are substantially aligned. It is noted that an arbitrary shape other than that shown in FIG. 1 or the like may be employed as long as it can connect glass tubes 2, 3.

As shown in FIG. 2, the opening of recess 49 exposes a light emitting portion 49 in each rare gas fluorescent lamp. Thus, the light from each rare gas fluorescent lamp is directed to the manuscript or the like through the opening.

Line light source 1 is fixed at two lamp holders 8, 9 and three fixing members 12. Thus, line light source 1 can be stably fixed to a casing or the like.

However, as long as the length of fixing member 12 is sufficiently large to stably fix line light source 1, two lamp holders 8, 9 need not be fixed to a casing, but line light source 1 may be fixed at one portion by fixing member 12.

In addition, for at least three glass tubes 2, 3 . . . , the ends of glass tubes 2, 3 . . . without lamp holders 8, 9 may be fixed by fixing member 12 such that the center lines of glass tubes 2, 3 . . . are aligned. In this case, although lamp holders 8, 9 may be provided at one end of each of the two glass tubes 2, 3 . . . at both ends of line light source 1, lamp holders 8, 9 are not provided for glass tubes 2, 3 . . . other than the above mentioned two glass tubes 2, 3 . . . at both ends.

As shown in FIG. 1, a space having a dimension X is provided between glass tubes, 2, 3. As a coefficient of thermal expansion of a casing (not shown) for fixing line light source 1 and that of line light source 1 are different, if two glass tubes 2, 3 are fixed in contact with each other, glass tubes 2, 3 may increase in length in relation to the casing for fixing line light source 1 due to a change in temperature and may break.

Accordingly, the space of dimension X is provided in consideration of the coefficient of thermal expansion of the casing for fixing line light source 1 and that of line light source 1. Thus, even if glass tubes 2, 3 thermally expand, the ends of glass tubes 2, 3 are prevented from coming into contact with each other and breaking.

Figure 4:
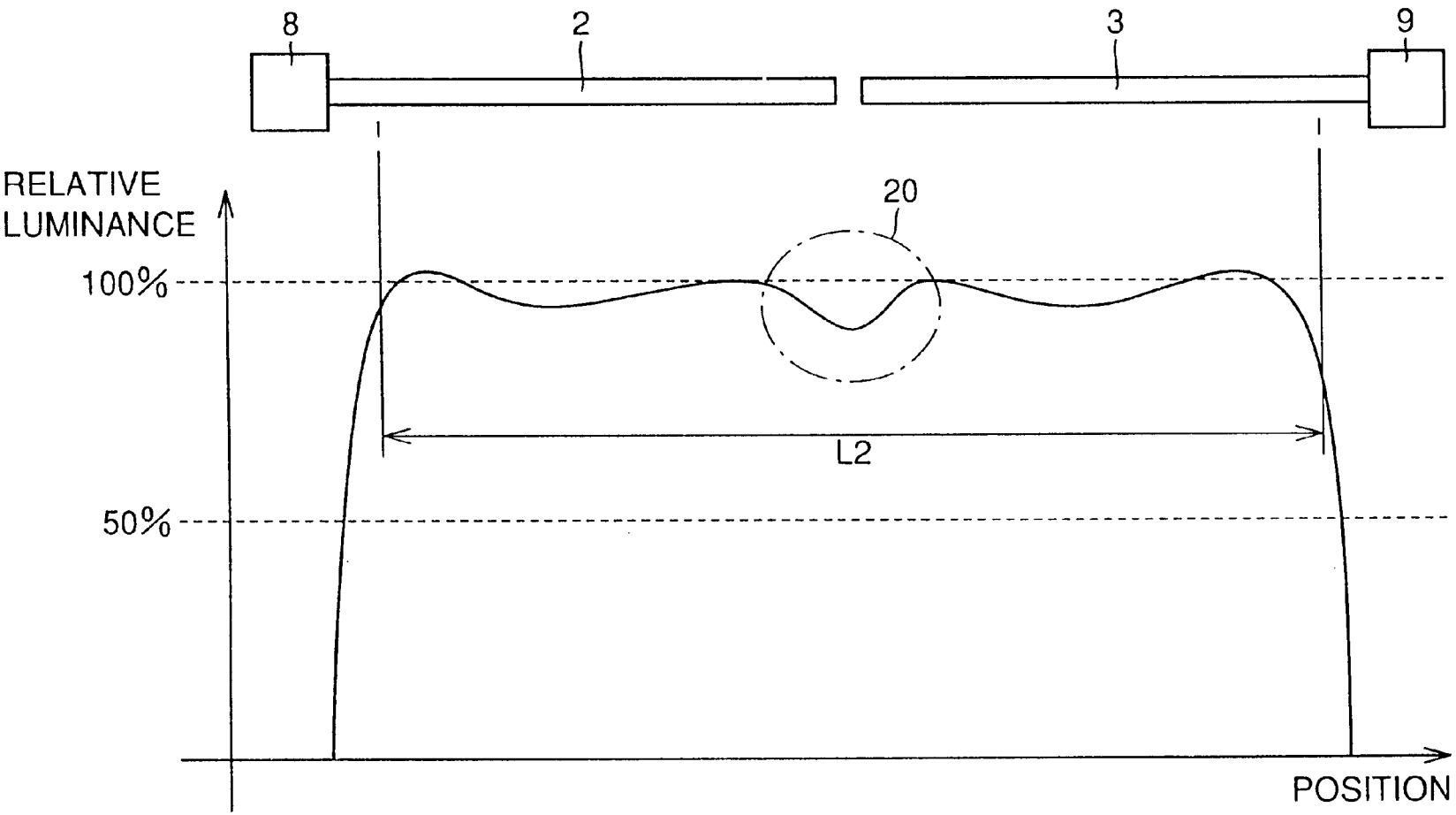
FIG. 4 is a graph showing a relationship between the relative luminance (brightness) and position of the line light source shown in FIG. 1.

Next, a distribution of the illumination light from the above mentioned line light source 1 will be described with reference to FIGS. 4 and 21. FIG. 4 is a graph showing a distribution of the illumination light from line light source 1, where an abscissa represents the position of line light source 1 and an ordinate represents a brightness (relative luminance).

Figure 21:
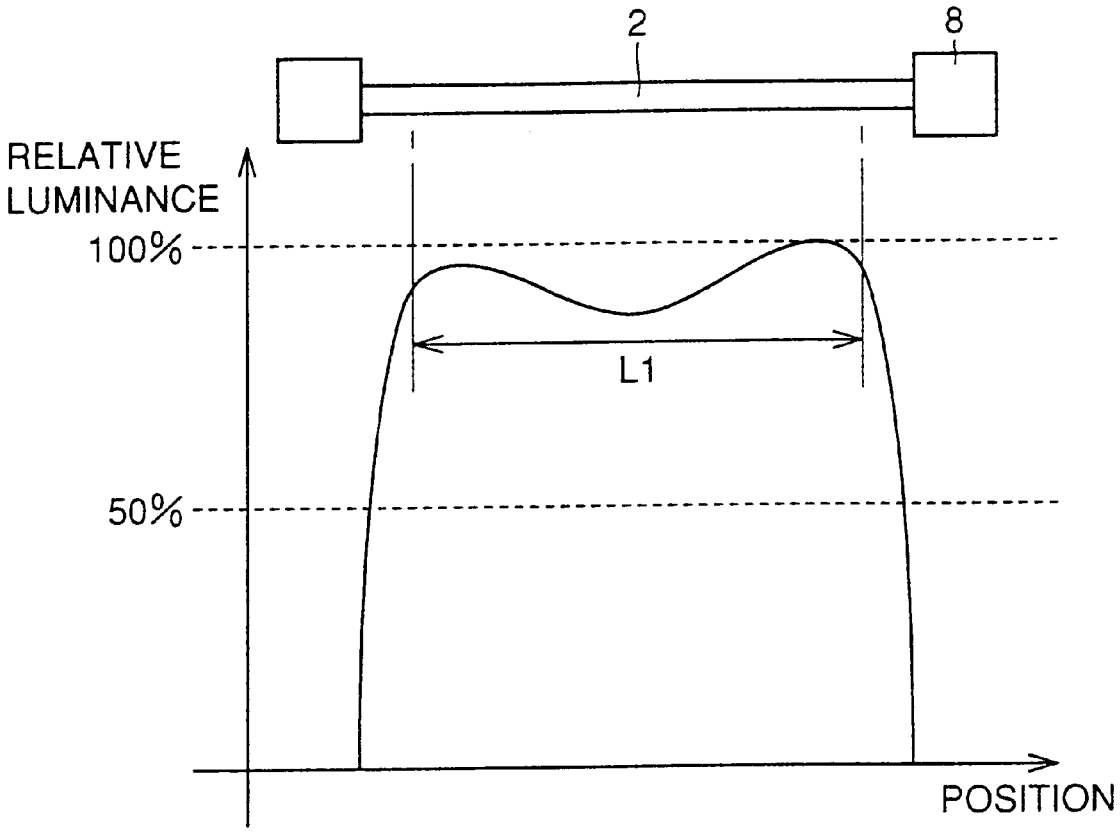
FIG. 21 PRIOR ART
FIG. 21 is a graph showing a relationship between the relative luminance (brightness) and position of a conventional line light source.

As shown in FIG. 21, the brightness of the illumination light from conventional line light source 1 decreases near lamp holder 8. Accordingly, for the illumination light from line light source 1 of the present embodiment, there is a valley of brightness near a region 20 in FIG. 4. The valley of brightness increases in depth as dimension X increases.

On the other hand, there is a variation in brightness in conventional line light source 1 as shown in FIG. 21. Thus, the image sensor using line light source 1 has an allowable range for the brightness of the illumination light.

Accordingly, if dimension X is determined such that the brightness of the illumination light falls within the allowable range, line light source 1 of the present embodiment can be used as a light source for an image sensor.

It is noted that, by fixing glass tubes 2, 3 such that center lines thereof are aligned, a maximum value of dimension X can be determined based on the distribution of the illumination light shown in FIG. 4. The total length of line light source 1 can be increased by maximizing dimension X.

The value of dimension X is appropriately selected to increase the luminance at the connecting portion of the rare gas fluorescent lamps. As a result, the light from the connecting portion of the rare gas fluorescent lamps can effectively be utilized as illumination light, so that a ratio of an effective illumination length L2 with respect to the total length of line light source 1 can be increased as compared with the conventional case.

Figure 3:
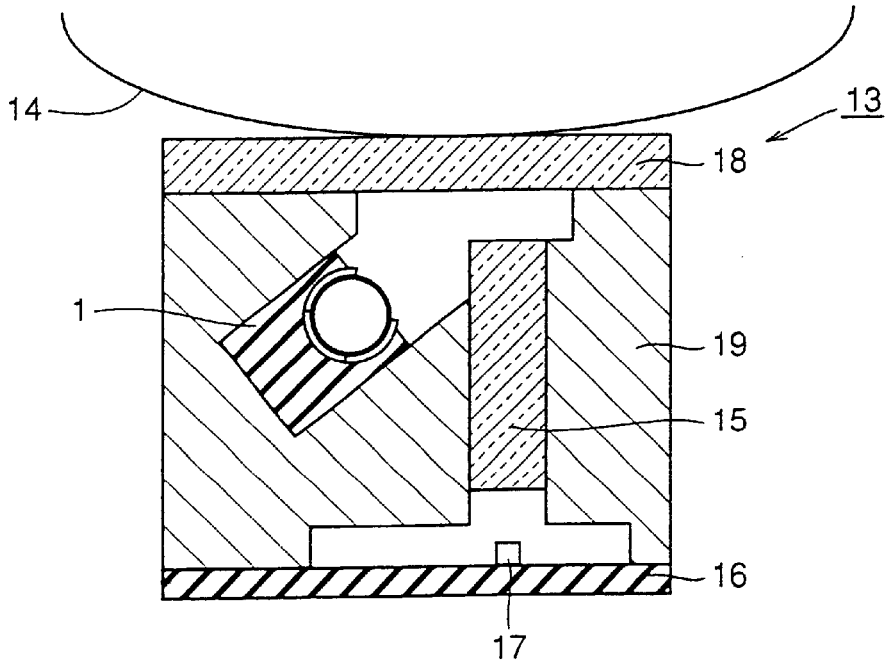
FIG. 3 is a cross sectional view of a contact image sensor having the line light source shown in FIG. 1.

Next, the above described line light source 1 as included in contact image sensor 13 will be described with reference to FIG. 3. FIG. 3 is a cross sectional view showing contact image sensor 13 including line light source 1 shown in FIG. 1.

As shown in FIG. 3, image sensor 13 includes; a casing (sensor frame) 19 holding components: a line light source 1; a rod lens array 15 for erect and equimagnification imaging including a plurality of rod lens; a sensor substrate 16; a sensor IC 17 linearly arranged on sensor substrate 16; and a glass plate 18 serving as a surface over which manuscript 14 is transported.

Image sensor 13 provided with large line light source 1 manufactured by connecting the plurality of rare gas fluorescent lamps can read a content of the manuscript having a size exceeding A3.

Second Embodiment

Figure 5:
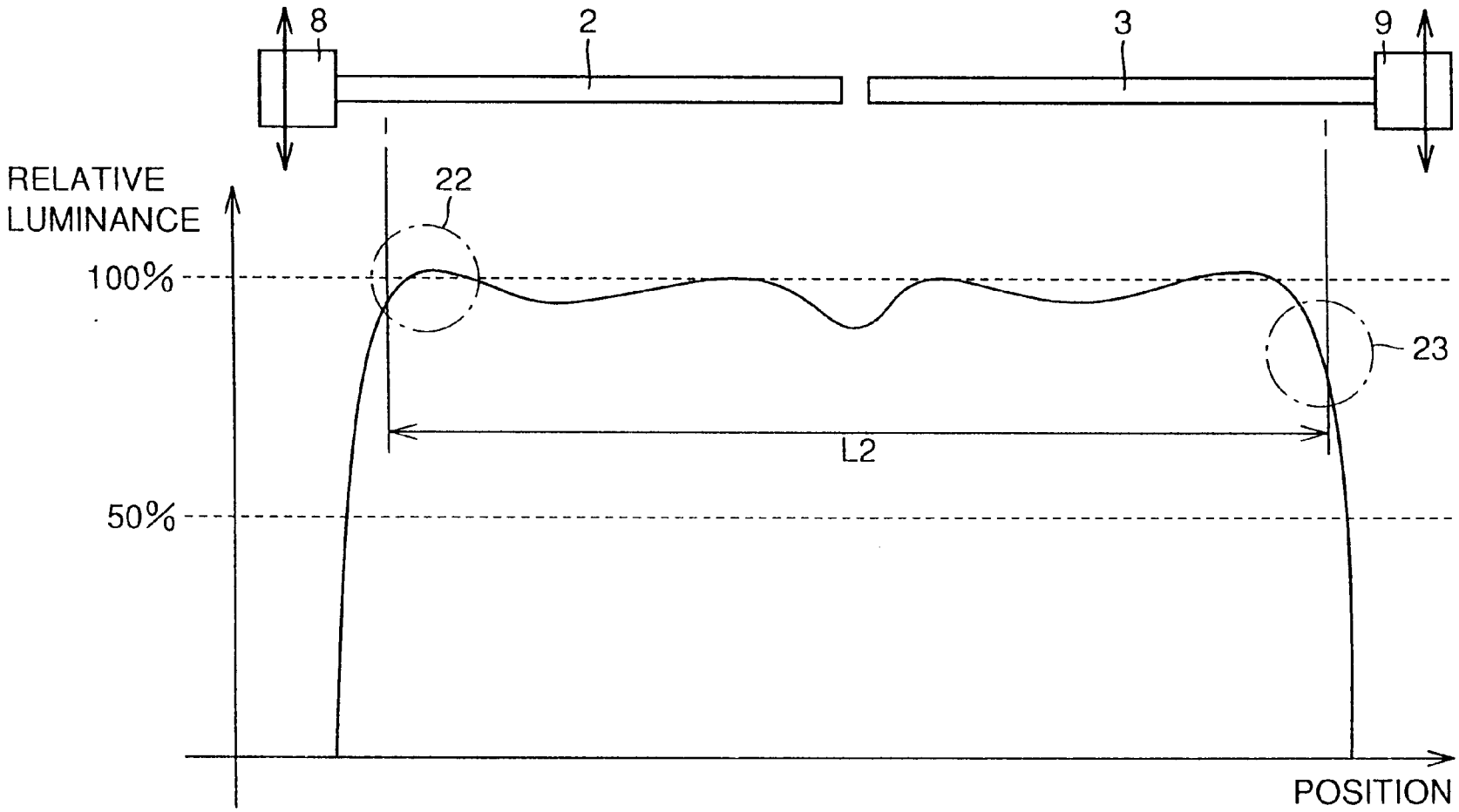
FIG. 5 is a graph showing a relationship between the relative luminance and position of a line light source according to the second embodiment of the present invention.
Figure 6:
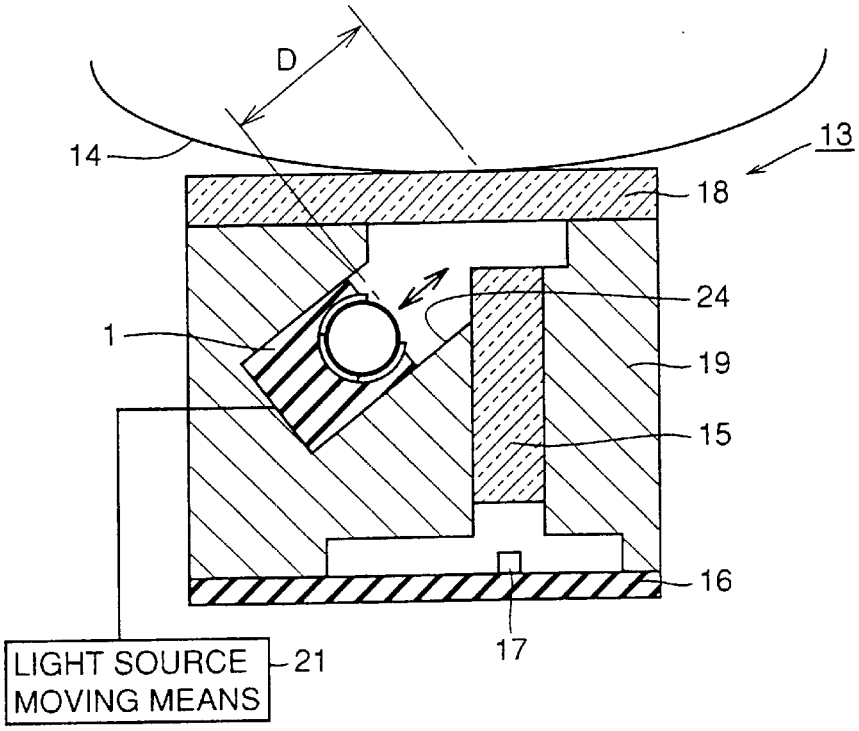
FIGS. 6 and 7 are cross sectional views respectively showing image sensors according to the second and third embodiments of the present invention.

Now, the second embodiment of the present invention will be described with reference to FIGS. 5 and 6. FIG. 5 is a graph showing a distribution of illumination light from a line light source 1 of the second embodiment, and FIG. 6 is a schematic diagram showing a contact image sensor 13 in the present embodiment.

In the second embodiment and the third embodiment which will later be described, image sensor 13 is provided with, as a key characteristic, a light source moving means for moving at least a part of line light source 1 in a desired direction.

Such provision of the light source moving means allows the position of line light source 1 to be adjusted, so that the brightness over the reading surface of the manuscript can be adjusted.

Next, the specific example of image sensor 13 in the second embodiment will be described with reference to FIG. 6. As shown in FIG. 6, image sensor 13 is provided with light source moving means 21 and line light source 1 is held in casing 9 such that it is movable over a guide surface 24. The other parts of the structure are the same as in FIG. 3, and therefore description thereof will not be repeated.

Light source moving means 21 drives line light source 1 in directions indicated by arrows in FIG. 6 over guide surface 24 to adjust the position of line light source 1. More specifically, line light source 1 is moved in at least one of directions toward and away from the reading surface of manuscript 14.

The brightness on manuscript 14 is determined by a distance D in FIG. 6. Namely, if distance D is small, the brightness on manuscript 14 is high. On the other hand, if distance D is large, the brightness on manuscript 14 is low. In addition, as shown in FIG. 5, line light source 1 has a region 22 with high relative luminance (bright) and a region 23 with low relative luminance (dark).

Then, if region 22 is too bright, for example, lamp holder 8 shown on the left side in FIG. 5 is moved in the direction away from manuscript 14 by light source moving means 21, so that the brightness over the reading surface of manuscript 14 illuminated with the light decreases approximately from region 22. As a result, a uniform brightness is obtained over the reading surface.

On the other hand, if region 23 is too dark, lamp holder 9 on the right side in FIG. 5 is moved in a direction toward manuscript 14 by light source moving means 21. Thus, the brightness over the reading surface of manuscript 14 illuminated with light increases approximately from region 23, so that a uniform brightness can be obtained over the reading surface also in this case.

As described above, when the brightness over the reading surface of manuscript 14 is insufficient, line light source 1 is moved in the direction toward the reading surface of manuscript 14 to increase the brightness over the reading surface of manuscript 14. On the other hand, when the brightness over the reading surface of manuscript 14 is too high, line light source 1 is moved in the direction away from the reading surface of manuscript 14 to decrease the brightness over the reading surface of manuscript 14.

It is noted that light source moving means 21 may be obtained by combining an element for clamping lamp holders 8, 9 and a mechanism for moving the element in directions indicated by arrows in FIG. 6, for example.

As described above, the second embodiment produces the same effect as in the first embodiment since the structures of the first and second embodiments are the same. In addition, since lamp holders 8, 9 can be moved forward or backward, a uniform brightness is obtained over the reading surface.

It is noted that although lamp holders, 8, 9 are moved in the above described example, the ends of glass tubes 2, 3 rather than lamp holder 8, 9 may directly be moved to produce a similar effect.

Third Embodiment

Figure 7:
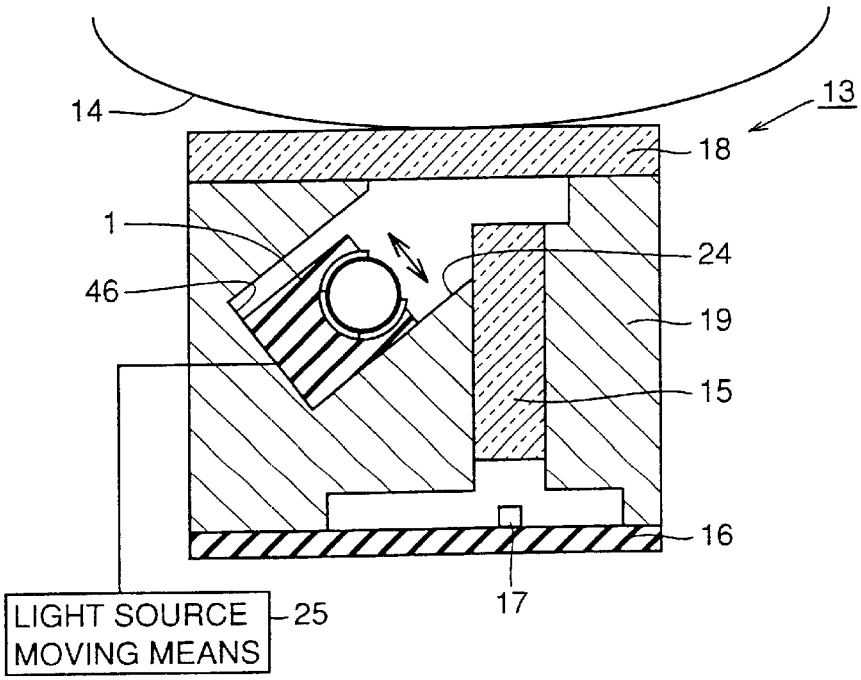

Next, the third embodiment of the present invention will be described with reference to FIGS. 7 and 8. FIG. 7 is a cross sectional view showing an image sensor 13 in the third embodiment.

As shown in FIG. 7, in the third embodiment, a guide surface 46 is provided in a casing 19 of image sensor 13, and image sensor 13 is provided with a light source moving means 25 for moving line light source 1 over guide surface 46. The other parts of the structure are the same as in FIG. 6, and therefore description thereof will not be repeated.

Figure 8:
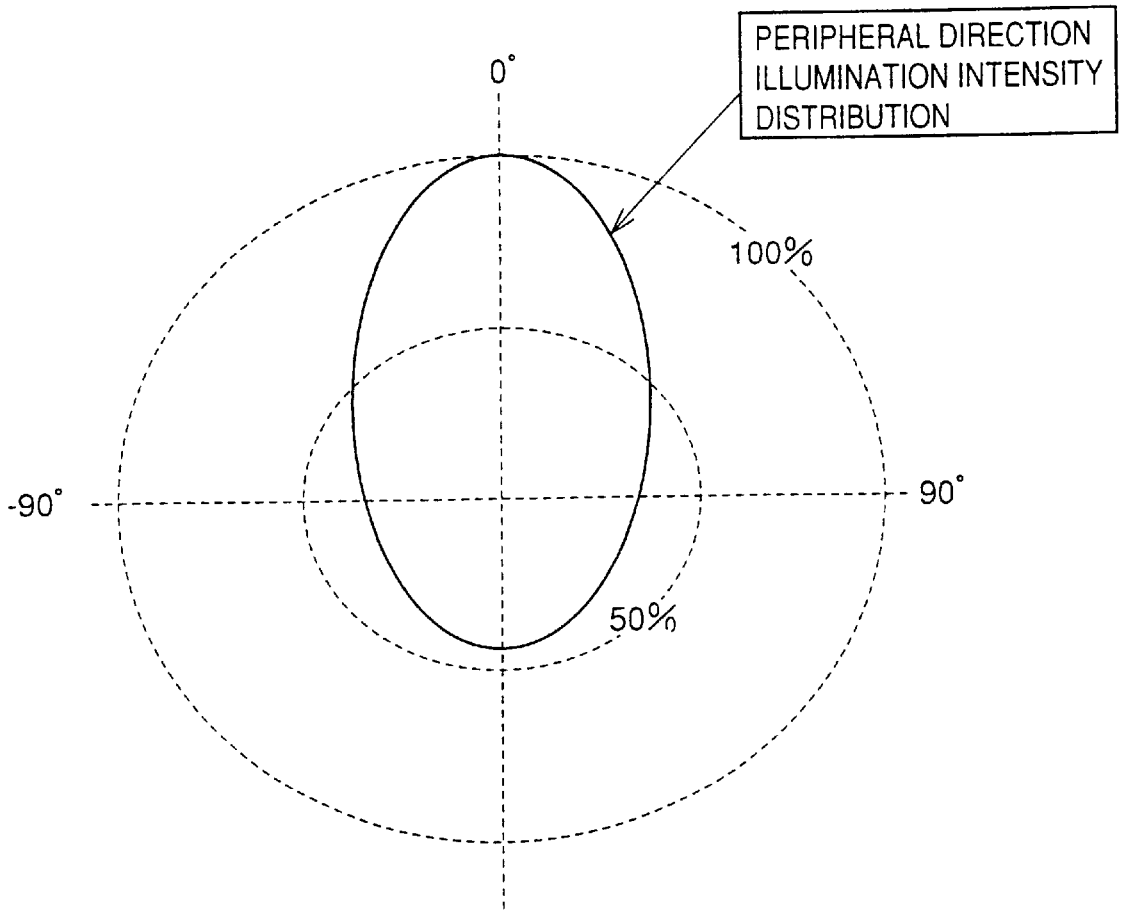
FIG. 8 is a diagram showing a periphery illumination intensity distribution of the line light source (external electrode rare gas fluorescent lamp) of the present invention.

FIG. 8 is a diagram showing a peripheral illumination intensity distribution of line light source 1 of the present invention using an external electrode rare gas fluorescent lamp. As shown in FIG. 8, it is apparent that the illumination intensity is distributed over the periphery of line light source 1, where the highest brightness is obtained in the direction of 0°. Accordingly, line light source 1 is preferably arranged such that the direction of 0° is toward manuscript 14.

Since line light source 1 has the peripheral illumination intensity distribution as described above, line light source 1 may be moved in directions indicated by arrows in FIG. 7 to change the brightness over manuscript 14. Namely, if line light source 1 is moved such that the direction of 0° is toward the reading surface of manuscript 14, the brightness over the reading surface is increased. On the other hand, as the direction of 0° is away from the reading surface, the brightness over the reading surface of manuscript 14 is reduced.

For example, if region 22 is too bright in FIG. 5, lamp holder 8 on the left side in the drawing is moved in one of the directions indicated by arrows in FIG. 7. Thus, the brightness over the reading surface of manuscript 14 illuminated with light from the portion corresponding to region 22 in line light source 1 can be reduced.

On the other hand, to increase the brightness of the reading surface, line light source 1 is moved such that the above mentioned direction of 0° is toward the reading surface of the manuscript. Thus, the brightness over the reading surface can be increased.

Since the brightness over the reading surface can be adjusted by moving line light source 1 in the directions indicated by the arrows in FIG. 7. a uniform brightness is obtained over the reading surface.

As described above, the third embodiment produces a similar effect as in the first embodiment since the structures of the first and third embodiments are the same. Further, since lamp holders 8, 9 can be moved in a direction normal to manuscript 14, a uniform brightness is obtained over the reading surface.

It is noted that light source moving means 25 may be obtained by combining an element for clamping lamp holders 8, 9 and a mechanism for moving the element in the directions indicated by the arrows in FIG. 7, for example. In addition, also in the third embodiment, the ends of glass tubes 2, 3 rather than lamp holders 8, 9 may directly be moved.

Fourth Embodiment

Figure 9:
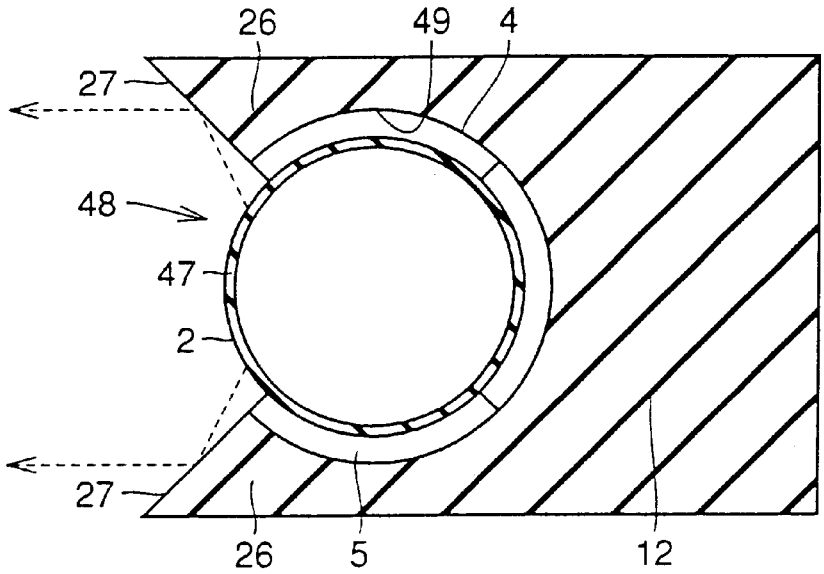
FIGS. 9 and 10 are cross sectional views respectively showing line light sources according to the fourth and fifth embodiments of the present invention.

Now, the fourth embodiment of the present invention will be described with reference to FIG. 9. FIG. 9 is a cross sectional view showing a line light source 1 in the fourth embodiment.

The fourth embodiment and the fifth embodiment which will later be described is provided with, as a key characteristic, a reflection surface for reflecting light from line light source 1 in fixing member 12. Such provision of reflection surface allows the light from line light source 1 to be reflected by the reflection surface, so that the luminance at the connecting portions of the plurality of rare gas fluorescent lamps forming line light source 1 can be increased.

In the fourth embodiment, fixing member 12 is provided with a protrusion 26 as shown in FIG. 9, and a reflection surface 27 is provided on the surface of protrusion 26. It is noted that a manuscript (not shown) is placed on the side opposite to fixing member 12 with respect to glass tube 2.

In the example shown in FIG. 9, the surface of protrusion 26 has a color tone of for example white or silver with high reflectivity (preferably at least 70%) with respect to the light from glass tube 2. Thus, the light from glass tube 2 is reflected as indicated by arrows in FIG. 9 and collected onto the manuscript. The other parts of the structure are the same as in the first embodiment.

Protrusion 26 protrudes in a direction in which the light from glass tube 2 is emitted. Thus, the provision of reflection surface 27 at an inner surface (on the side of emitting portion 48) of protrusion 26 prevents expansion of the light from glass tube 2. As a result, the luminance at the connecting portion of glass tubes 2, 3 can effectively be increased.

As described above, the fourth embodiment produces the same effect as in the first embodiment since the first and fourth embodiments have the same structure. In addition, the brightness over the manuscript near fixing member 12 increases and the brightness is not reduced in a region 20 in FIG. 4. Thus, line light source 1 with a uniform brightness is obtained.

Fifth Embodiment

Figure 10:
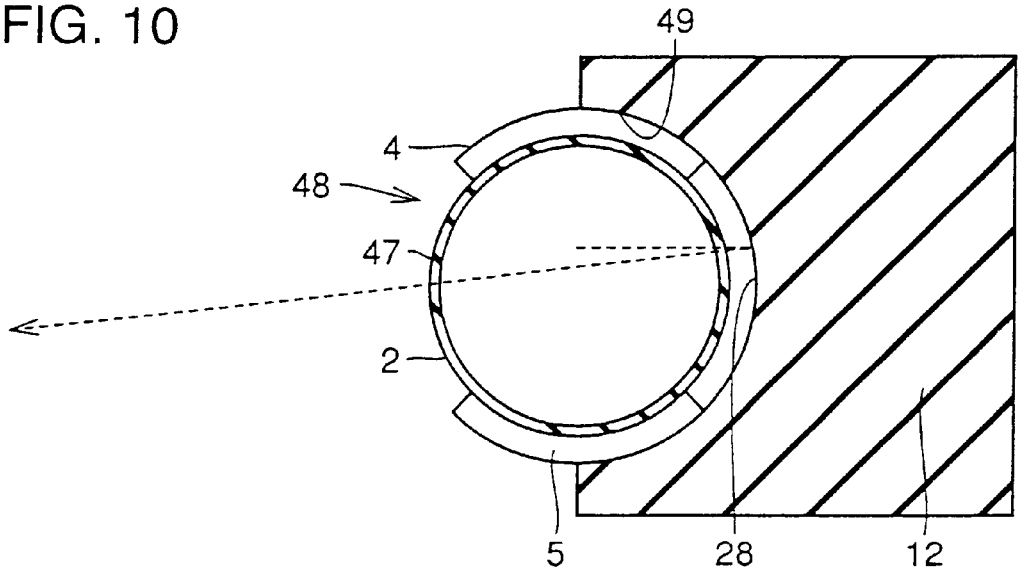

The fifth embodiment of the present invention will be described with reference to FIG. 10. FIG. 10 is a cross sectional view showing a line light source 1.

As shown in FIG. 10, in the fifth embodiment, the surface of fixing member 12 on the side opposite to glass tube 2 has a color tone such as white with high reflectivity with respect to the light from glass tube 2. Thus, the light from glass tube 2 in the direction toward fixing member 12 is reflected as indicated by an arrow in FIG. 10 and collected onto the manuscript.

The other parts of the structure are the same as in the first embodiment. The fifth embodiment produces an effect similar to that in the above described fourth embodiment.

It is noted that although the entire surface of fixing member 12 may have a color tone with high reflectivity, only a portion of the surface of fixing member 12 that can reflect the light from glass tubes 2, 3 may have a color tone with high reflectivity.

Sixth Embodiment

Figure 11:
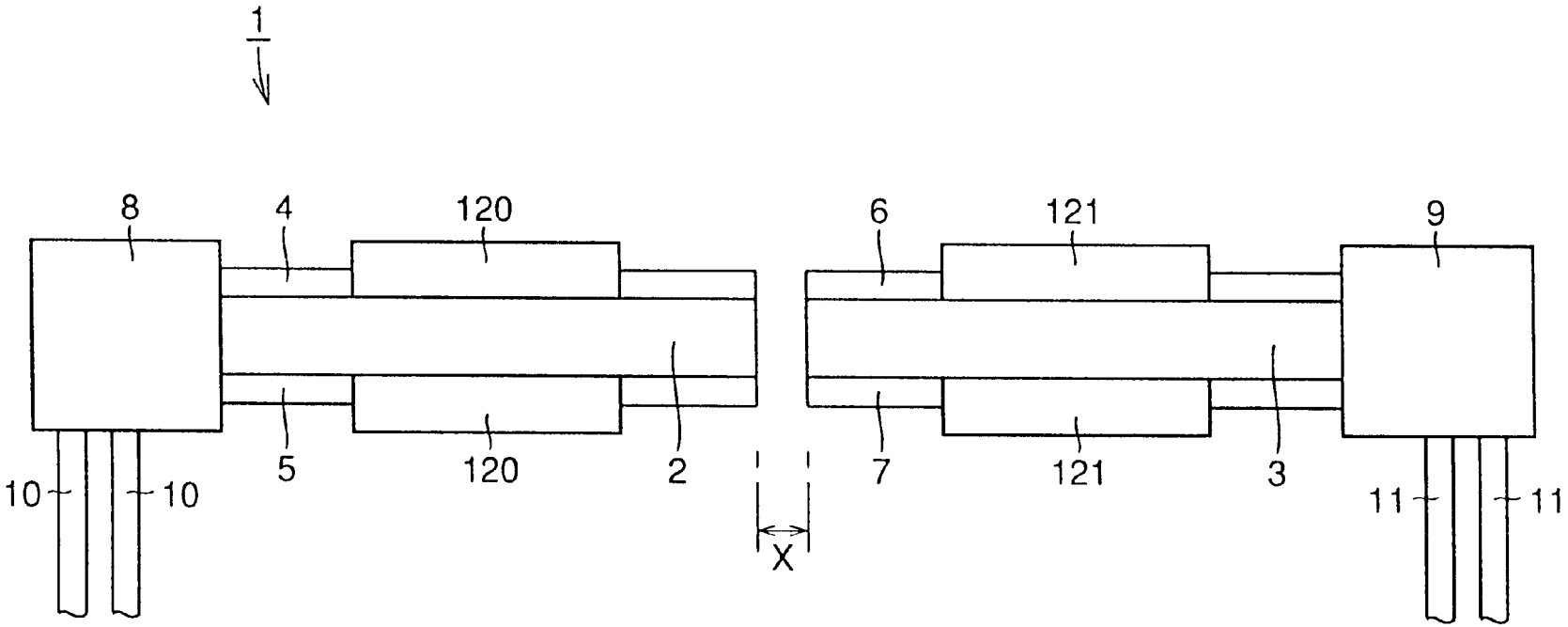
FIGS. 11 and 12 are top views respectively showing line light sources according to the sixth and seventh embodiments of the present invention.

The sixth embodiment of the present invention will be described with reference to FIG. 11. FIG. 11 is a top view showing a line light source 1.

As shown in FIG. 10, in the sixth embodiment, two fixing members 120, 121 are provided. Thus, line light source 1 is fixed by lamp holders 8, 9 at both ends and two fixing members 120, 121.

It is noted that as long as fixing members 120, 121 are long enough to stably fix line light source 1 to a casing, lamp holders 8, 9 are not necessarily used for fixing line light source 1. Line light source 1 may be fixed to the casing only by fixing members 120, 121.

In addition, lamp holders 8, 9 may not be provided and fixing may be performed at the ends of glass tubes 2, 3. However, in this case, fixing must be performed at two portions by fixing members 120, 121.

Further, at least three glass tubes 2, 3 . . . may be fixed to the casing of the image sensor such that the center lines of glass tubes 2, 3 . . . are aligned by using fixing members 120, 121 . . . In this case, lamp holders 8, 9 may be mounted to glass tubes 2, 3 . . . positioned at both ends, but lamp holders 8, 9 may not be provided.

Seventh Embodiment

Figure 12:
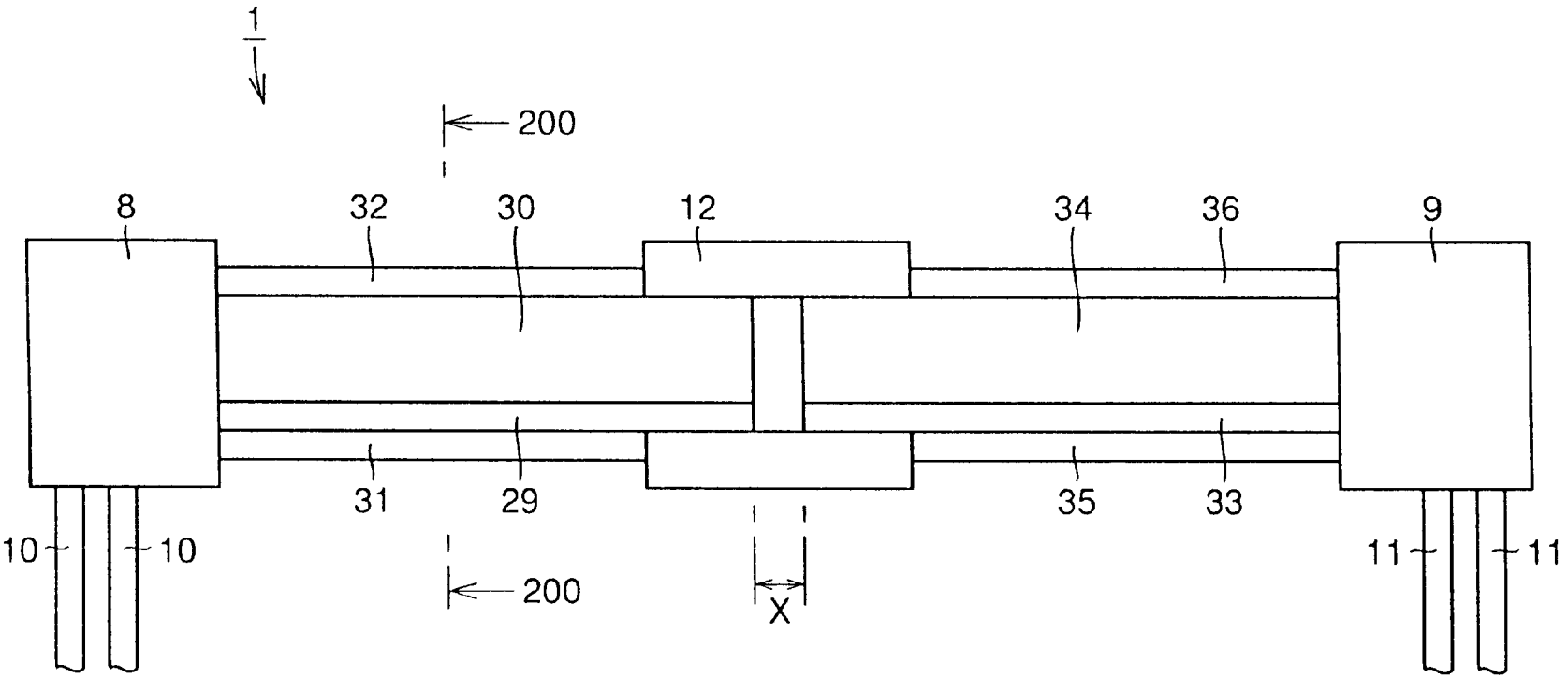

The seventh embodiment of the present invention will be described with reference to FIGS. 12 to 15. FIG. 12 is a top view showing a line light source 1 in the seventh embodiment.

Although cylindrical glass tubes 2, 3 are used in each of the above first to sixth embodiments, line light source 1 may be manufactured by employing a hollow glass structure having a shape other than a cylinder. Thus, even when a rare gas fluorescent lamp having a shape other than a cylinder is used, an effect similar to that of the first embodiment is produced.

As shown in FIG. 12, line light source 1 is provided with two rare gas fluorescent lamps connected by fixing member 12. One rare gas fluorescent lamp includes a glass structure of first and second glass substrates 29 and 30, as well as first and second electrodes 31, 32 formed on the surfaces of the glass structure.

The other rare gas fluorescent lamp includes a glass structure of first and second glass substrate 33 and 34, as well as first and second electrodes 35, 36 formed on the surfaces of the glass structure. The other parts of the structure are the same as in the first embodiment, and therefore description thereof will not be repeated.

Figure 13:
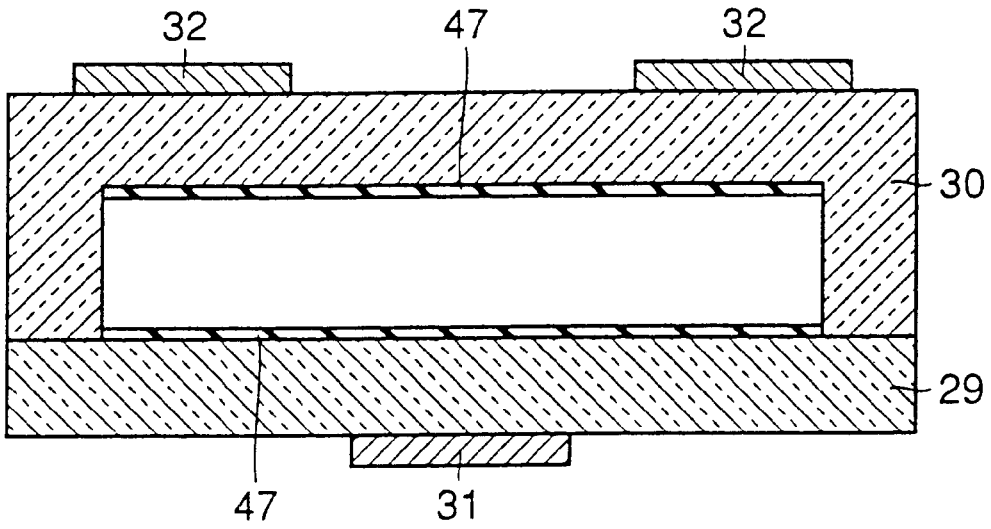
FIG. 13 is a cross sectional view taken along the line 200—200 in FIG. 12.

FIG. 13 is a cross sectional view taken along the line 200—200 in FIG. 12. As shown in FIG. 13, second glass substrate 30 in a box-like shape is placed on first glass substrate 29 to form a glass structure. The glass structure is internally provided with a discharging space, and a fluorescent material 47 is applied to the inner wall of the glass structure. An inactive gas (xenon or the like, not using mercury) is introduced to the discharging space.

First and second electrodes 31, 32 are provided on the opposite sides of the discharging space, each is connected to one lead wire 10. A high frequency voltage is applied to first and second electrodes 31, 32 through lead wire 10.

Figure 14:
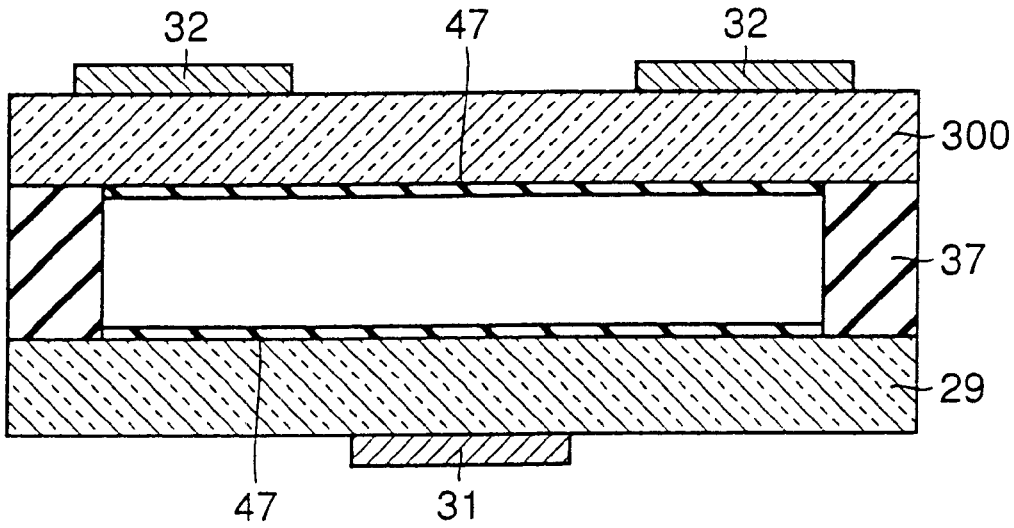
FIGS. 14 and 15 are cross sectional views showing modifications of the line light source in FIG. 13.
Figure 15:
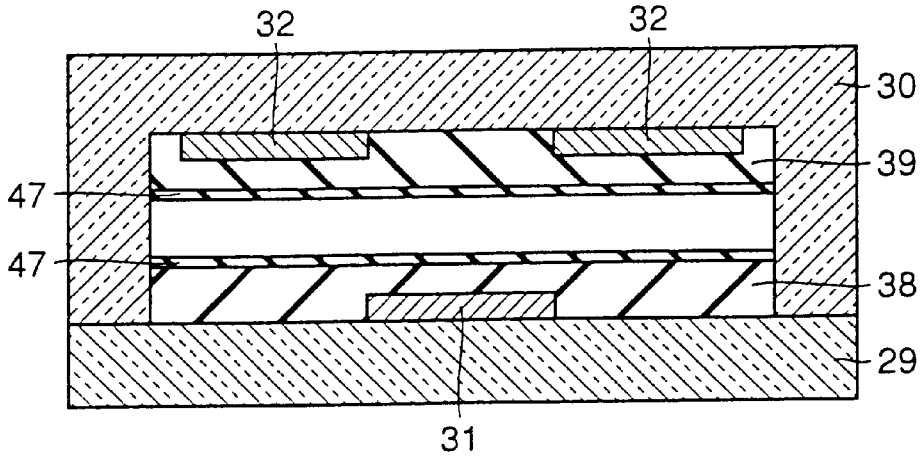
Figure 16:
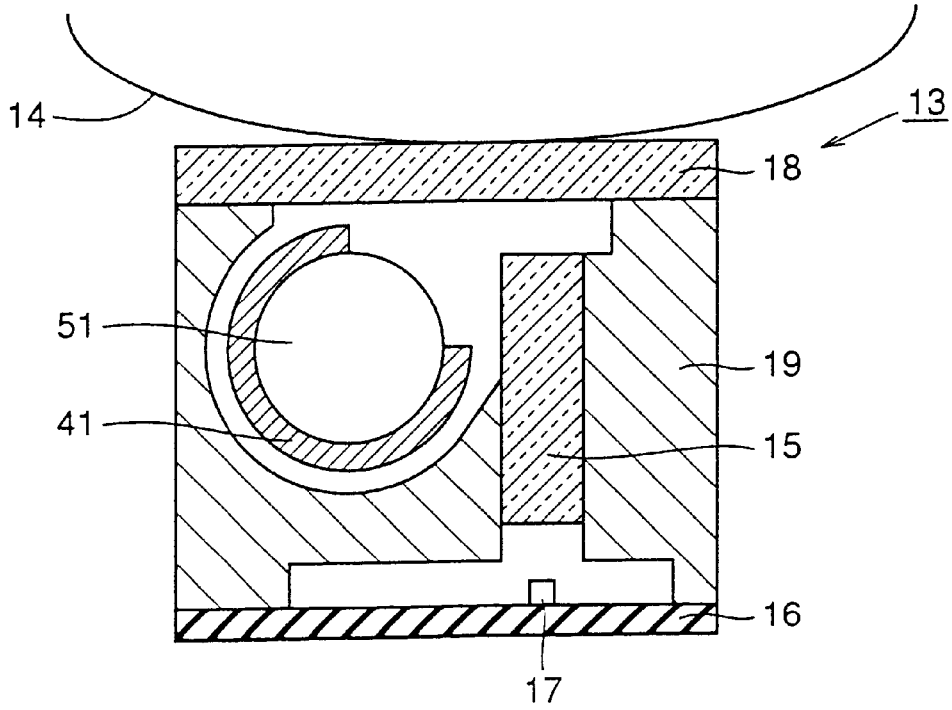
FIG. 16 PRIOR ART
FIG. 16 is a cross sectional view showing a conventional contact image sensor.
Figure 17:
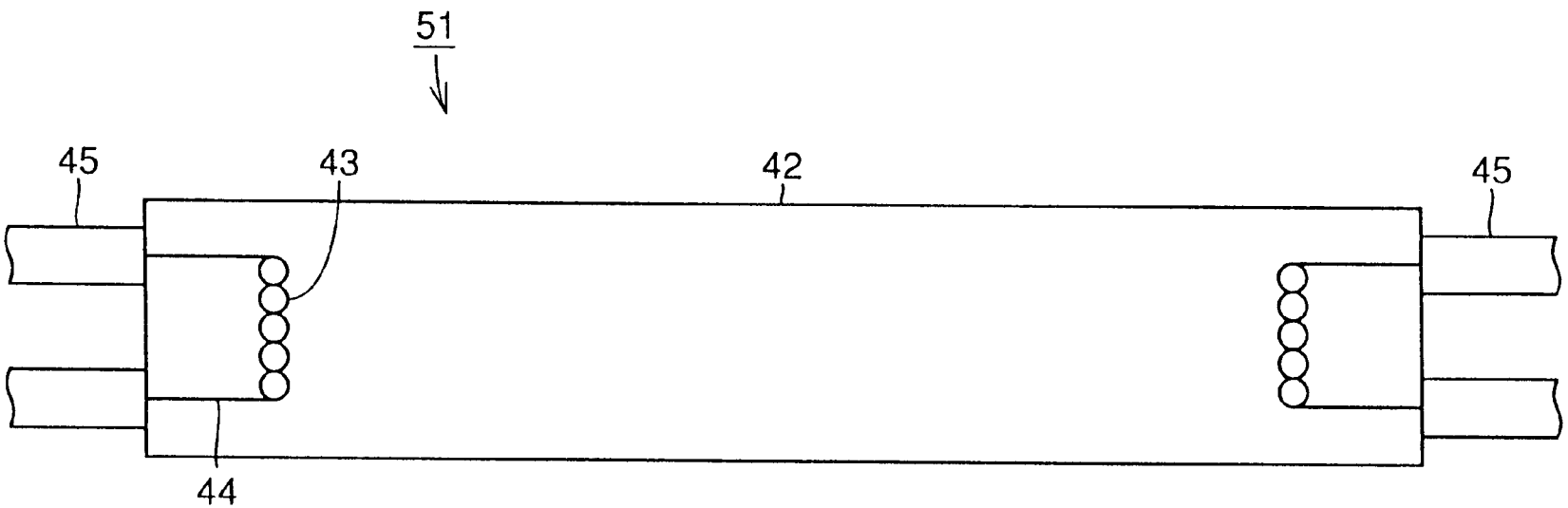
FIG. 17 PRIOR ART
FIG. 17 is a top view showing as an example a conventional line light source.
Figure 18:
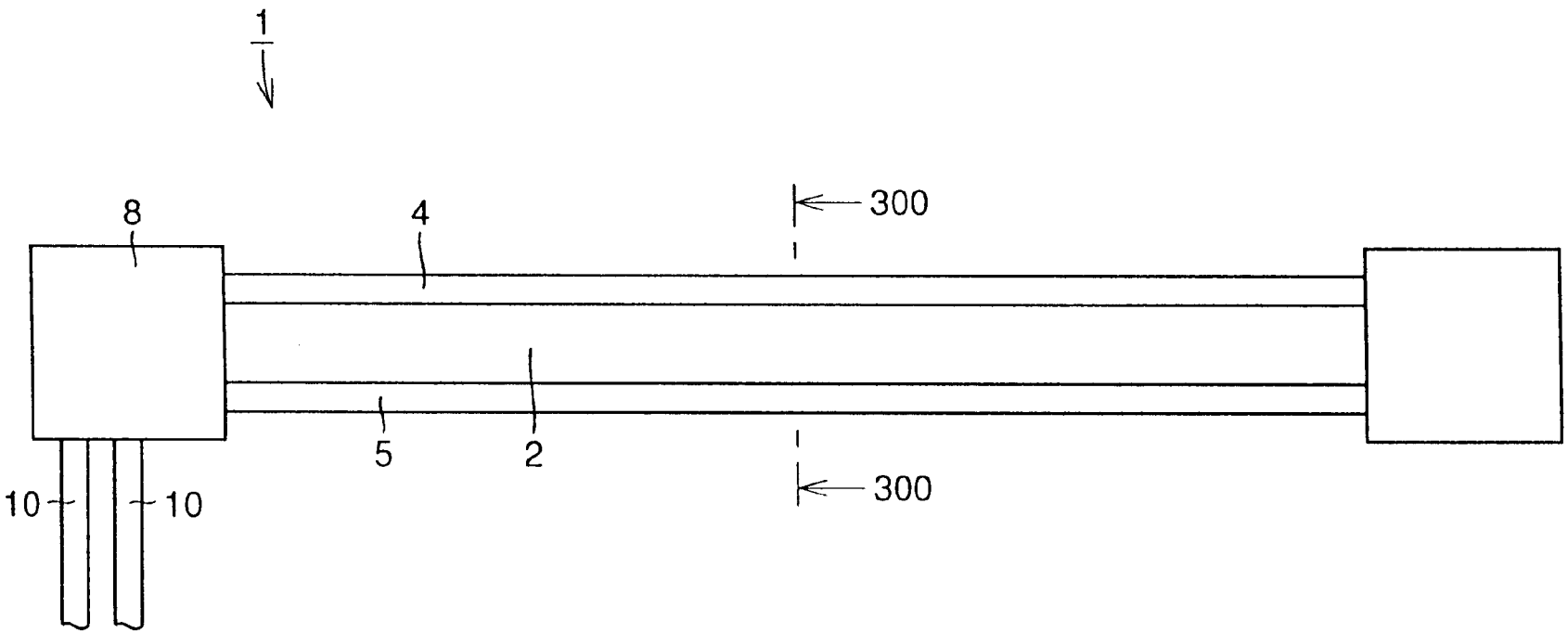
FIG. 18 PRIOR ART
FIG. 18 is a tope view showing as another example a conventional line light source.
Figure 19:
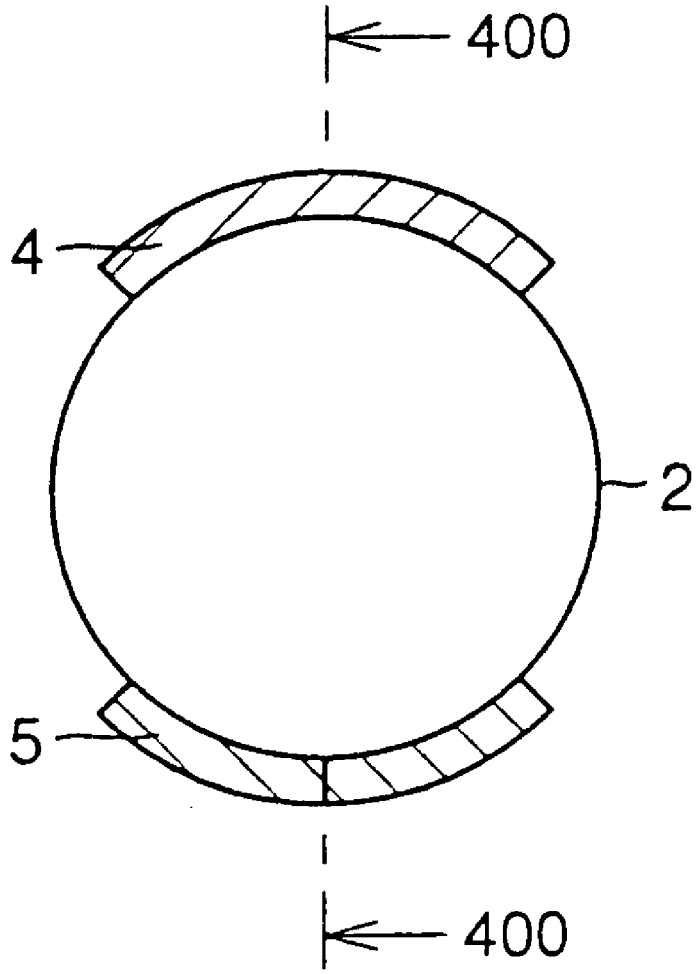
FIG. 19 PRIOR ART
FIG. 19 is a cross sectional view taken along the line 300—300 in FIG. 18.
Figure 20:
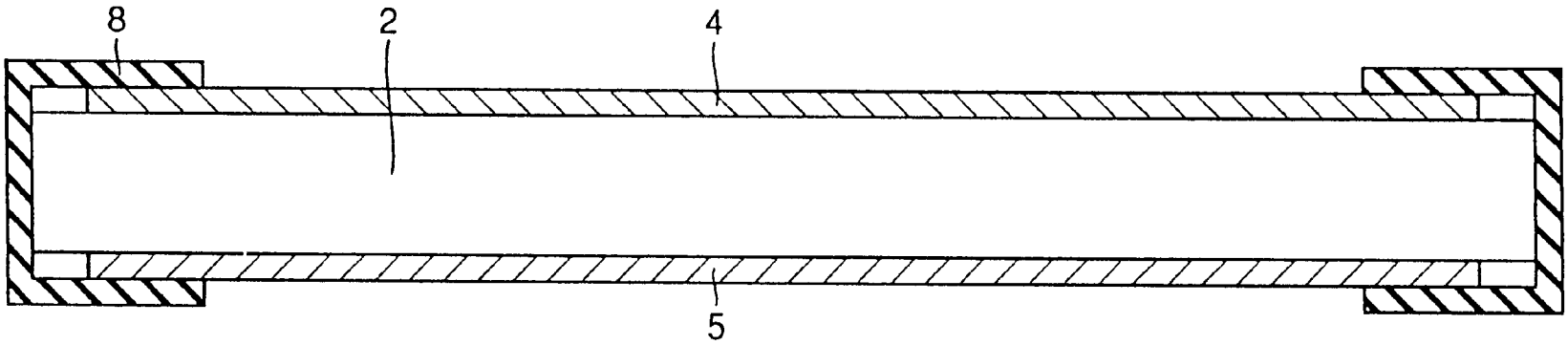
FIG. 20 PRIOR ART
FIG. 20 is a cross sectional view taken along the line 400—400 in FIG. 19.

FIGS. 14 and 15 show a modification of the rare gas fluorescent lamp shown in FIG. 13. As shown in FIG. 14, in the present modification, second glass substrate 300 is in a plate-like shape, and a wall 37 is formed between second glass substrate 300 and first glass substrate 29. Wall 37 is formed for example of glass or other insulating material. The other parts of the structure are the same as in the case of FIG. 13.

As shown in FIG. 15, first and second electrodes 31, 32 are arranged inside the glass structure, and insulating layers (dielectric layers) 38, 39 are formed to cover first and second electrodes 31, 32. A fluorescent material 37 may be applied to insulating layers 38, 39. The other parts of the structure are the same as in the case of FIG. 13.

According to the present invention, the length of the line light source can readily be increased. Thus, a line light source which can be used for a large image inputting portion having a size exceeding A3 is obtained by using as a light source a rare gas fluorescent lamp with a limited length. In addition, since the line light source is formed by using the rare gas fluorescent lamp, a luminance is stable with respect to an ambient temperature. Moreover, as mercury is not used, adverse effect on the environment is prevented.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A line light source, comprising:

a first rare gas fluorescent lamp including a first hollow body having an inner wall with a fluorescent material applied and having an inactive gas in an internal space thereof, and first and second electrodes positioned on opposite sides of said internal space of said first hollow body;

a second rare gas fluorescent lamp including a second hollow body having an inner wall with a fluorescent material applied and having an inactive gas in an internal space thereof, and third and fourth electrodes positioned on opposite side of said internal space of said second hollow body; and a fixing member fixing said first and second rare gas fluorescent lamps arranged in a longitudinal direction thereof, wherein said fixing member connects the first and second rare gas fluorescent lamps with a void space formed between said first and second hollow bodies.

2. The line light source according to claim 1, wherein said fixing member fixes said first and second rare gas fluorescent lamps such that center lines of said first and second rare gas fluorescent lamps are aligned in said longitudinal direction.

3. The line light source according to claim 1, wherein said fixing member has a recess receiving one ends of said first and second rare gas fluorescent lamps and an opening exposing light emitting portions of said first and second rare gas fluorescent lamps.

4. The line light source according to claim 1, wherein said line light source is included in a casing, and said line light source is fixed to said casing using said fixing member.

5. The line light source according to claim 1, wherein said fixing member connects the first and second rare gas fluorescent lamps with a space formed between said first and second hollow bodies.

6. The line light source according to claim 1, wherein said fixing member is provided with a reflection surface for reflecting light from at least one of said first and second rare gas fluorescent lamps.

7. The line light source according to claim 6, wherein said fixing member has a protrusion protruding in a direction in which light from said first or second rare gas fluorescent lamp is directed, and said reflection surface is provided on said protrusion.

8. The line light source according to claim 7, wherein said reflection surface is provided by making a surface of said protrusion have a color tone with high reflectivity with respect to the light from said first or second rare gas fluorescent lamp.

9. The line light source according to claim 6, wherein said reflection surface is provided by making a surface of said fixing member opposite to said first or second rare gas fluorescent lamp have a color tone with high reflectivity with respect to the light from said first or second rare gas fluorescent lamp.

10. An image sensor provided with the line light source of claim 1.

11. An image sensor comprising:

a line light source comprising:

a first rare gas fluorescent lamp including a first hollow body having an inner wall with a fluorescent material applied and having an inactive gas in an internal space thereof, and first and second electrodes positioned on opposite sides of said internal space of said first hollow body;

a second rare gas fluorescent lamp including a second hollow body having an inner wall with a fluorescent material applied and having an inactive gas in an internal space thereof, and third and fourth electrodes positioned on opposite side of said internal space of said second hollow body; and a fixing member fixing said first and second rare gas fluorescent lamps arranged in a longitudinal direction thereof;

a casing including said line light source and a glass plate fixedly mounted to said casing; and moving means for moving said line light source over a guide surface of said casing.

12. The image sensor according to claim 11, wherein said moving means moves said line light source in at least one of directions toward and away from a reading surface of a manuscript.

13. The image sensor according to claim 11, wherein said moving means moves said line light source such that an illumination intensity at the reading surface of the manuscript is changed.

14. An image sensor comprising:

a line light source comprising:

a first rare gas fluorescent lamp including a first hollow body having an inner wall with a fluorescent material applied and having an inactive gas in an internal space thereof, and first and second electrodes positioned on opposite sides of said internal space of said first hollow body;

a second rare gas fluorescent lamp including a second hollow body having an inner wall with a fluorescent material applied and having an inactive gas in an internal space thereof, and third and fourth electrodes positioned on opposite side of said internal space of said second hollow body; and a fixing member fixing said first and second rare gas fluorescent lamps arranged in a longitudinal direction thereof;

a casing including said line light source; and moving means for moving said line light source, wherein said moving means can move part of said line light source to adjust light intensity at one end of said line light source.

* * * * *